US008621892B2

(12) United States Patent
Moon et al.

(10) Patent No.: US 8,621,892 B2
(45) Date of Patent: Jan. 7, 2014

(54) CLOTH TREATING APPARATUS

(71) Applicants: Taechul Moon, Seoul (KR); Kayeon Kim, Seoul (KR); Ayeong Lee, Seoul (KR); Sogkie Hong, Seoul (KR); Junghwan Lee, Seoul (KR)

(72) Inventors: Taechul Moon, Seoul (KR); Kayeon Kim, Seoul (KR); Ayeong Lee, Seoul (KR); Sogkie Hong, Seoul (KR); Junghwan Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 13/658,288

(22) Filed: Oct. 23, 2012

(65) Prior Publication Data

US 2013/0098121 A1 Apr. 25, 2013

(30) Foreign Application Priority Data

Oct. 24, 2011 (KR) ..... 10-2011-0108608

(51) Int. Cl.
*B08B 3/12* (2006.01)

(52) U.S. Cl.
USPC ..... 68/5 C; 68/12.08; 68/222; 68/264; 134/30; 134/102.1; 134/103.2; 134/131; 34/130; 34/72; 34/218

(58) Field of Classification Search
USPC ..... 68/5 C, 12.08, 222, 264, 265, 5 R; 134/200, 18, 30, 37, 102.1, 102.3, 134/22.15, 103.2, 131, 103.3, 143, 151, 134/158; 8/137; 34/218, 202, 132, 60, 130, 34/595, 72, 524, 603
See application file for complete search history.

(56) References Cited

U.S. PATENT DOCUMENTS

| | | | | |
|---|---|---|---|---|
| 5,609,047 | A * | 3/1997 | Hellman et al. | 68/222 |
| 2005/0035076 | A1 | 2/2005 | Schober | |
| 2010/0058813 | A1 | 3/2010 | Moon et al. | |
| 2012/0240425 | A1 * | 9/2012 | Park et al. | 34/202 |
| 2012/0317729 | A1 * | 12/2012 | Song et al. | 8/137 |

FOREIGN PATENT DOCUMENTS

| | | | | |
|---|---|---|---|---|
| DE | 2156607 | | 5/1973 | |
| DE | 19929052 | | 11/2000 | |
| EP | 122569 | A2 * | 10/1984 | D06F 73/00 |
| JP | 2009247898 | | 10/2009 | |
| KR | 10-2009-0052460 | A | 5/2009 | |
| KR | 10-2010-0130351 | A | 12/2010 | |
| KR | 10-2011-0067833 | A | 6/2011 | |
| WO | WO 2011/108860 | | 9/2011 | |

* cited by examiner

*Primary Examiner* — Michael Barr
*Assistant Examiner* — Thomas Bucci
(74) *Attorney, Agent, or Firm* — McKenna Long & Aldridge LLP

(57) ABSTRACT

A cloth treating apparatus is disclosed, including a cabinet having a housing space for housing cloth, a water supply unit for supplying steam to the housing space selectively, and a water spray unit movably provided to one side of the cabinet to be connected to the water supply unit selectively for supplying the steam from the water supply unit to the cloth.

15 Claims, 13 Drawing Sheets

CLOTH TREATING APPARATUS

This application claims the benefit of the Patent Korean Application No. 10-2011-0108608, filed on Oct. 24, 2011, which is hereby incorporated by reference as if fully set forth herein.

BACKGROUND OF THE DISCLOSURE

1. Field of the Disclosure

The present invention relates to a cloth treating apparatus, and more particularly, to a cloth treating apparatus for washing, and/or drying laundry.

2. Discussion of the Related Art

In general, the cloth treating apparatus includes a washing machine for washing laundry, a dryer for drying the laundry, and a drying and washing machine for washing and drying the laundry. And, in the dryer, there may be a drum type dryer and a cabinet type dryer depending on a space which houses the cloth. The drum type dryer is of a type the space which houses the cloth, i.e., the drum, rotates, and the cabinet type dryer is of a type the space which houses the cloth does not move. The Korea Patent Application No. 10-2007-0018389 discloses the cabinet type dryer, titled "DRYER AND METHOD FOR CONTROLLING THE DRYER".

A related art dryer will be described with reference to FIG. 17. The dryer is provided with a cabinet for housing a drying object, a low temperature air producing unit (Not shown) for producing a relatively low temperature air to be supplied to the cabinet for drying the drying object, and a flow passage (Not shown) for supplying the relative low temperature air from the low temperature air producing unit to the cabinet. And, different from the drum type dryer, the cloth is housed in the cabinet in a secured state. It is preferable that a supporting element 5 is provided in the cabinet for hanging the cloth therefrom.

In the meantime, the related art cloth treating apparatus is not provided with elements for removing wrinkles and smells from the cloth, and, moreover, has difficulty for solving a problem of local contamination on the cloth.

SUMMARY OF THE DISCLOSURE

Accordingly, the present invention is directed to a cloth treating apparatus for removing wrinkles and/or smells from cloth for solving above problems.

An object of the present invention is to provide a cloth treating apparatus for providing means for providing high temperature steam to a contaminated portion of a cloth intensively if the cloth is contaminated locally for removing the contamination.

Additional advantages, objects, and features of the disclosure will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a cloth treating apparatus includes a cabinet having a housing space for housing cloth, a water supply unit for supplying steam to the housing space, selectively, and a water spray unit movably provided to one side of the cabinet to be connected to the water supply unit selectively for supplying the steam from the water supply unit to the cloth, wherein the water spray unit comprises a housing movably provided to one side of the housing space to have an opened upper side, a coupling unit provided to the housing for selective connection to the water supply unit according to movement and action of the housing, and a water supply gun connected to the coupling unit and extended to a predetermined distance for supplying the steam toward the cloth.

Advantageous Effects of the Invention

As described before, the present invention is characterized in that the supply unit which supplies the steam is not secured to an inside of the cloth treating apparatus, but is movable freely in a state the steam is being supplied in a case relatively high temperature steam is supplied. Therefore, if the cloth is contaminated at a local portion, such as an elbow thereof, the high temperature steam may be supplied only to the local portion which is contaminated, such as the elbow intensively by moving the supply unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DESCRIPTION OF SPECIFIC EMBODIMENTS

Reference will now be made in detail to the specific embodiments of the present invention, examples of which are illustrated in the accompanying drawings. Wherever possible, the same reference numbers will be used throughout the drawings to refer to the same or like parts.

Figure 1:
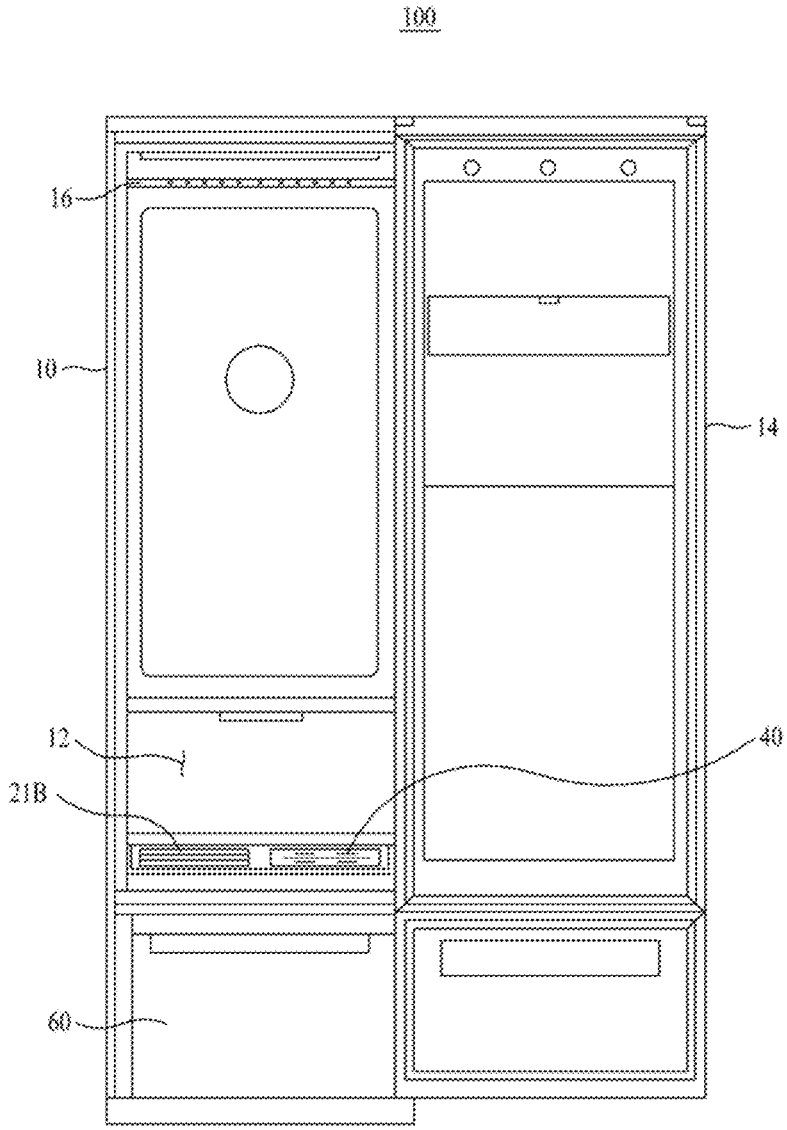
FIG. 1 illustrates a front view of a cloth treating apparatus in accordance with a preferred embodiment of the present invention.

FIG. 1 illustrates a front view of a cloth treating apparatus in accordance with a preferred embodiment of the present invention, with a door 14 opened state.

Though the present invention describes a refresher which supplies heated air to cloth for refreshing the cloth, the present invention is not limited to this, but is applicable to other devices which are provided with heat pumps. The refresh may mean a process for providing air, heated air, water, mist and steam toward the cloth for removing wrinkles from the cloth, deodorizing the cloth, sanitizing the cloth, preventing static electricity, or warming the cloth. Moreover, the cloth mentioned in the specification includes, not only objects a person may wear, such as clothes, and apparel, but also shoes, socks, gloves, a headgear, and a muffler, but also objects a person may use, such as a doll, a handkerchief, and blanket, i.e., all objects which require washing.

Referring to FIG. 1, the cloth treating apparatus 100 includes a cabinet 10 which forms a housing space 12 for housing cloth therein. The cabinet 10 houses the cloth and forms an exterior appearance of the cloth treating apparatus. The cloth treating apparatus 100 includes a water supply unit (See FIG. 5) for spraying water, mist, or steam (Hereafter will be called as 'steam', collectively) to the housing space 12. And, the cloth treating apparatus 100 may also include an air supply unit 22 (See FIG. 5) for supplying air or heated air to the housing space 12. And, the cloth treating apparatus 100 may also include a control unit (Not shown) for controlling the water supply unit 30 and the air supply unit 22.

The cabinet 19 has various elements which will be described later provided thereto, and the housing space 12 provided therein. The housing space 12 is in communication with an outside of the cabinet 10 by a door 14 selectively. Moreover, the housing space 12 has various kinds of supporters 16 provided thereto for hanging the cloth therefrom. The supporter 16 may be provided such that the cloth maintains a stationary state, or a secured state, without movement. In the meantime, as described later, the supporter may be configured to apply a predetermined movement to the cloth if the air, the heated air, or the steam is supplied to the cloth, which will be described with reference to FIGS. 2 and 3.

Figure 2:
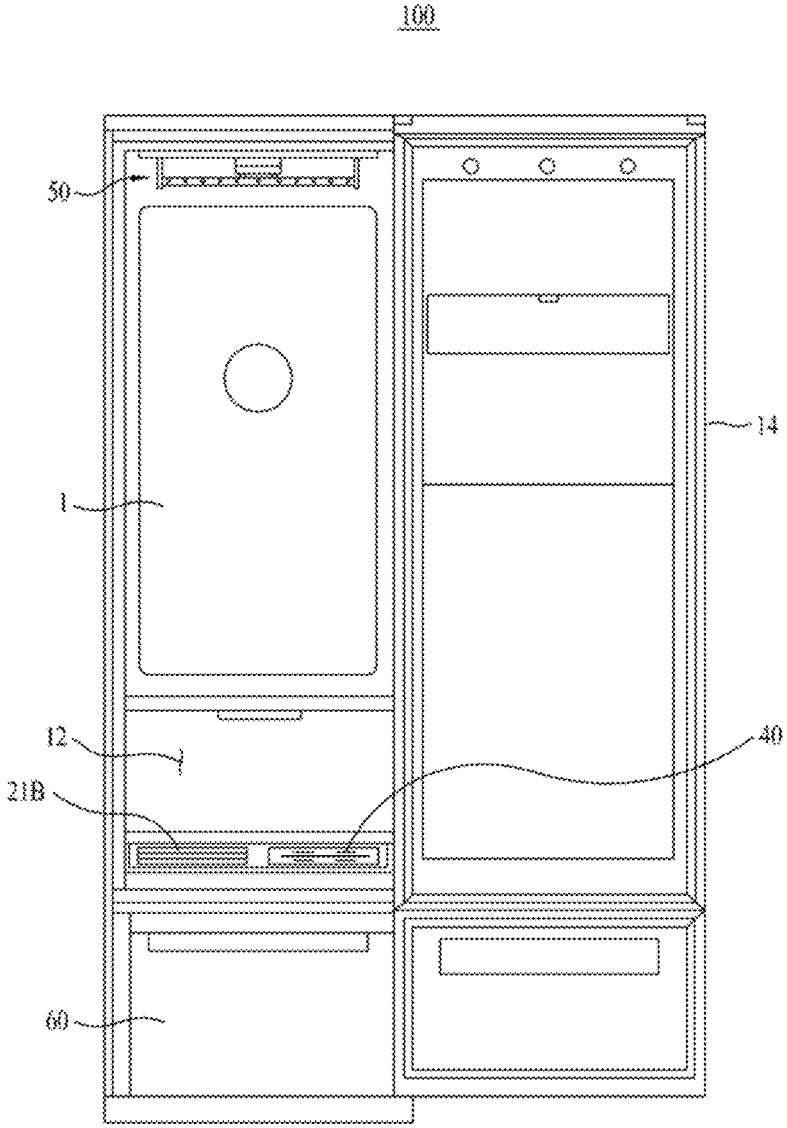
FIG. 2 illustrates a front view of a cloth treating apparatus in accordance with another preferred embodiment of the present invention.

FIG. 2 illustrates a front view of a cloth treating apparatus in accordance with another preferred embodiment of the present invention. In comparison to the first embodiment, the cloth treating apparatus of another preferred embodiment is different in that the cloth treating apparatus of another preferred embodiment includes a movable hanger. The cloth treating apparatus of another preferred embodiment of the present invention will be described focused on the difference.

Referring to FIG. 2, there is the movable hanger 50 provided in the housing space 12 for hanging the cloth therefrom. The movable hanger 50 is configured to apply predetermined movement to the cloth. If the predetermined movement is applied to the cloth in a case the air, the heated air, or the steam is supplied to the cloth, a refresh effect of the cloth will be enhanced.

Figure 3:
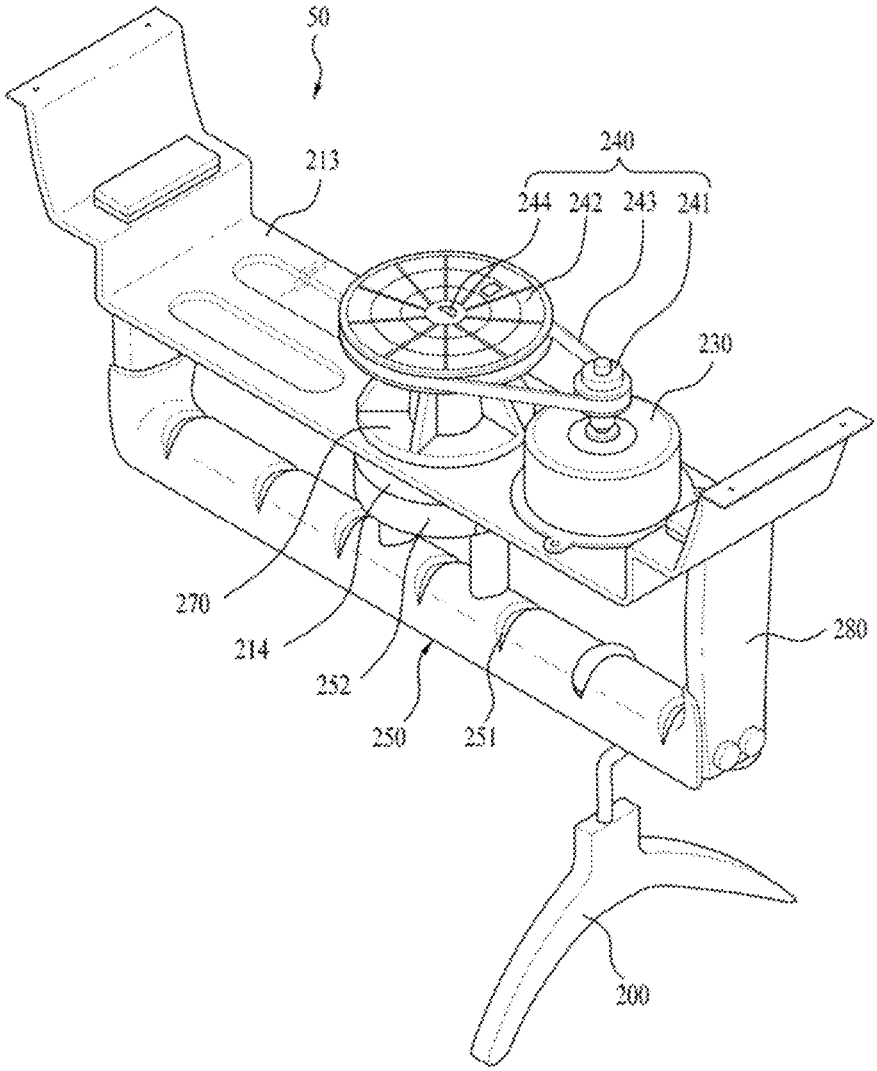
FIG. 3 illustrates a perspective view of a movable hanger in the cloth treating apparatus in FIG. 2.
Figure 4:
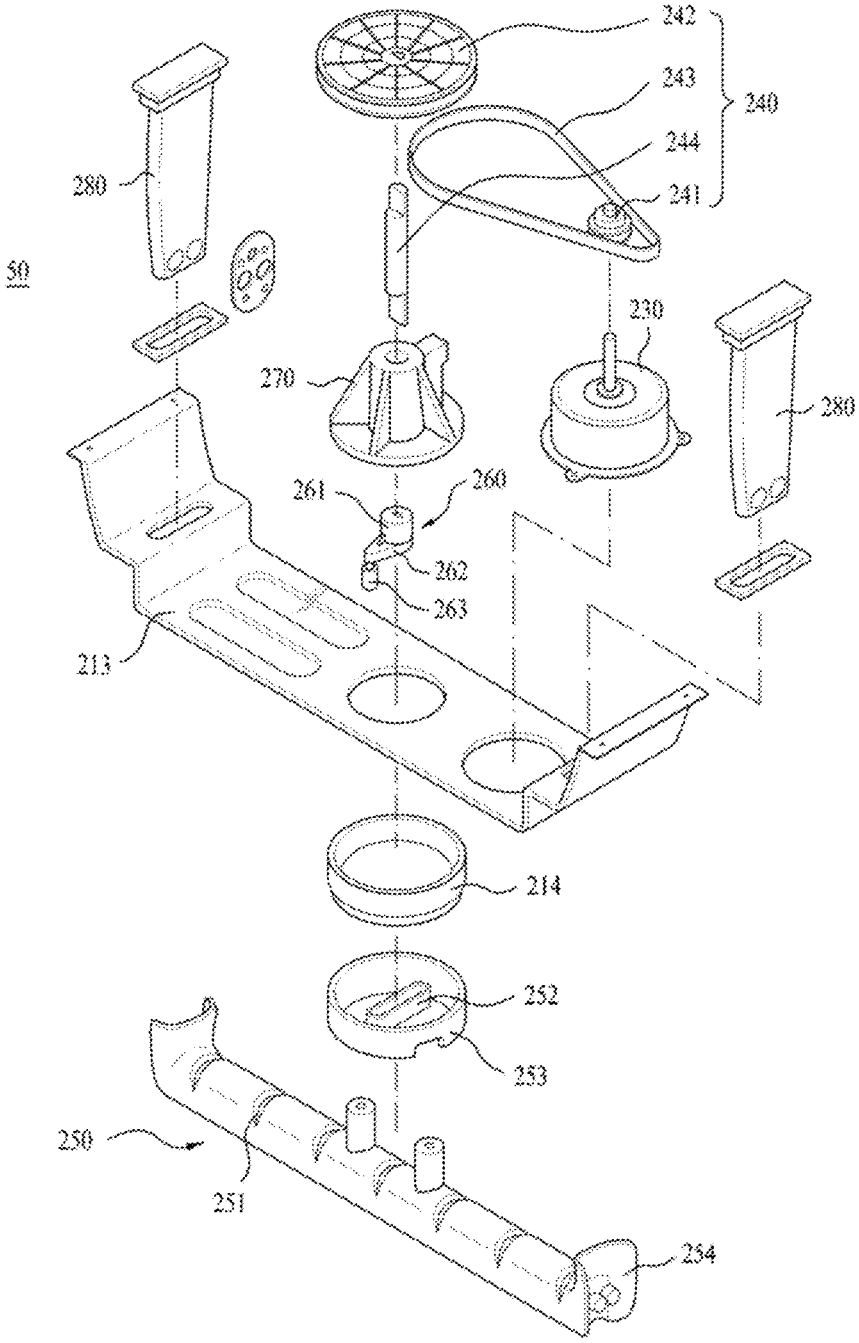
FIG. 4 illustrates an exploded perspective view of FIG. 3.

FIG. 3 illustrates a perspective view of a movable hanger 50, and FIG. 4 illustrates an exploded perspective view of the movable hanger 50.

Referring to FIGS. 3 and 4, the movable hanger 50 includes a hanger bar 250 for supporting a cloth hanger 200 having the cloth hung therefrom, and a supporter 280 for supporting both ends of the hanger bar 250. The hanger bar 250 has a plurality of cloth hanger grooves 251 provided therein for positioning the cloth hanger 200 when the cloth hanger 200 is placed thereon. The supporter 280 is connected to, and supported by, a movable hanger frame 213 provided to an upper side of an inside of ceiling of the cabinet 10 to be invisible from an outside of the cabinet 10. The hanger bar 250 has both ends provided with supporter ribs 254 to surround, and to be connected to, the supporter 280, respectively.

Therefore, since the cloth treating apparatus of the embodiment has the cloth placed therein hung from the cloth hanger, the cloth treating apparatus has effects much better than the related art cloth treating apparatus, not only in refreshing, but also in drying efficiency of the cloth.

In the meantime, the movable hanger 50 includes a motor 230, a power converter 260 for converting rotating movement from the motor 230 to a horizontal linear movement of the hanger bar 250, and a power transmitter 240 for transmission of the power from the motor 230 to the power converter 260.

The power transmitter 240 may include a driving pulley 241 provided to the motor 230, a driven pulley 242 connected to the driving pulley 241 with a belt 243, and a rotating shaft 244 coupled to a center of the driven pulley 242. The rotating shaft 244 is rotatably mounted in a bearing housing 270 provided to the movable hanger frame 213.

It is preferable that the hanger bar 250 further includes a slot 252 perpendicular to a length direction of the hanger bar 250. In detail, the hanger bar 250 has a slot housing 254 over the hanger bar 250, with the slot 252 provided in the slot housing 253 at a center thereof, substantially. And, the power converter 260 may include a slot pin 263 placed in the slot 252, a shaft coupler 261 coupled to the rotating shaft 244, and a rotatable arm 262 connected between the slot pin 263 and the shaft coupler 261. The power converter 260 is covered with a cover 214 to make the power converter 260 invisible from an outside of the movable hanger 50 provided between the movable hanger frame 213 and the slot housing 253.

In above configuration, if the motor 230 rotates, the driven pulley 242 rotates to rotates the rotating shaft 244 coupled to the driven pulley 242 too, such that the slot pin 263 makes a circular motion with a predetermined diameter.

In the meantime, the slot 252 is provided to the hanger bar 250 perpendicular to a length direction of the hanger bar 250, with a length thereof longer than a rotating locus of the slot pin 263. Therefore, even if the slot pin 263 makes the circular motion, the slot 252 makes a horizontal linear motion. According to this, the hanger bar 250 coupled to the slot 250 makes the horizontal linear motion, too.

In the meantime, a machinery room 20 is provided to in the cabinet 10, which houses the air supply unit 22 and the water supply unit 30. Preferably, the machinery room 20 is positioned under the housing space 12, and has the air supply unit 22 and the steam generating unit 32 of the water supply unit 30 provided therein. The machinery room 20 is positioned under the housing space 12 thus because it is preferable that the machinery room 20 positioned under the housing space 12 supplies the heated air and the steam upward by using a rising nature of the heated air and the steam being supplied to the housing space 12.

Figure 5:
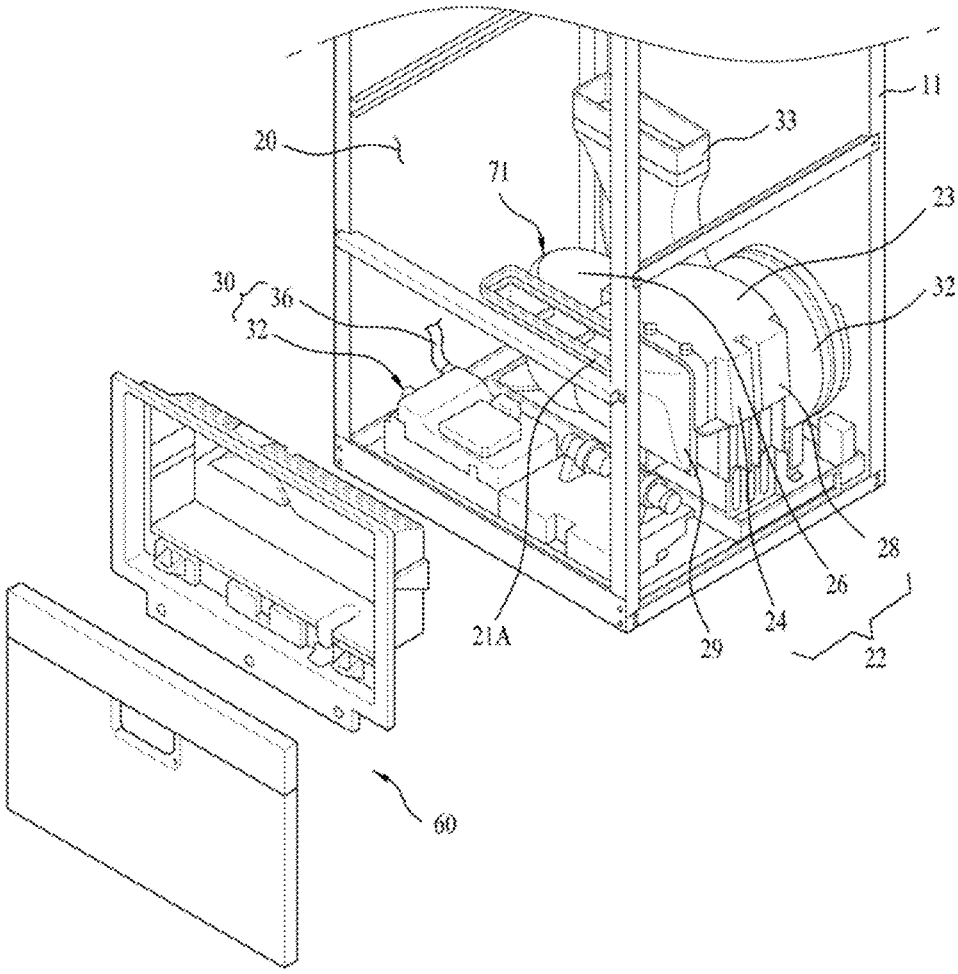
FIG. 5 illustrates a perspective view of an inside of a machinery room in the cloth treating apparatus.

FIG. 5 illustrates a perspective view of an inside of the machinery room 20, schematically. In order to show the inside of the machinery room 20, FIG. 5 illustrates a frame which is a skeleton of the cabinet 10 only, for convenience of view. And, for convenience of description, FIG. 5 illustrates major elements, including the air supply unit and the water supply unit 30, but not pipelines which connect the major elements.

Referring to FIG. 5, the machinery room 20 has the water supply unit 30 provided thereto for supplying the steam to the housing space 12, selectively.

The water supply unit 30 may include the steam generating unit 32 for heating the water to generate the steam, a water supply line 36 for guiding the steam from the steam generating unit 32 to the housing space 12. Moreover, the water supply unit 30 may further include a water supply nozzle 40 at an end of the water supply line 36 for supplying the steam.

The steam generating unit 32 has a heater (Not shown) provided therein for heating the water to produce the steam to be supplied to the housing space 12. As a water supply source for supplying the water to the steam generating unit 32, an external water faucet may be used or a water supply tank (Not shown) provided to one side of the machinery room 20 may be used.

Preferably, the water supply tank may be provided to a door module detachably mounted to one side of the machinery room 20, and the water supply tank may be detachably provided to the door module 60. Accordingly, the user can detach the water supply tank from the machinery room 20, fills the water supply tank with the water, and mounts the water supply tank to the machinery room 20, again.

The steam produced from the steam generating unit 32 is supplied to the housing space 12 through the water supply line 36. If the water supply nozzle 40 is provided, the steam may be supplied to the housing space 12 to have a direction by using the water supply nozzle 40. In this case, in order to prevent a temperature of the steam from dropping or the steam from condensing during the steam flows along the water supply line 36, it is favorable that the water supply line 36 is the shorter. Accordingly, if the machinery room 20 is positioned under the housing space 12, it is preferable that the water supply nozzle 40 supplies the steam through an upper side of the machinery room 20, i.e., an underside of the housing space 12.

And, the machinery room 20 may have a circulating fan (Not shown) provided to a rear thereof. The circulating fan supplies the air to the machinery room 20 from an outside of the machinery room 20 for preventing a temperature of an inside of the machinery room 20 from rising excessively due to operation of the heat pump 22 and the water supply unit 30.

In the meantime, in the machinery room 20, there is the air supply unit 22 for supplying air or the heated air to the housing space 12.

In the cloth treating apparatus in accordance with a preferred embodiment of the present invention, a heat pump serves as the air supply unit. That is, the heat pump 22 has an evaporator 24, a compressor 26, a condenser 28, and an expansion valve (Not shown) for dehumidifying and heating the air.

That is, as the refrigerant vaporizes at the evaporator 24, the refrigerant absorbs latent heat from surrounding air to cool down the air to condense moisture in the air, thereby removing the moisture from the air. And, if the refrigerant from the compressor 26 is introduced to, and condensed at, the condenser 28, the refrigerant discharges the latent heat to surrounding air to heat the surrounding air. According to this, since the evaporator 24 and the condenser 28 function as heat exchangers, the air introduced to the machinery room 20 has moisture thereof removed, or is heated, and supplied to the housing space 12.

Though the air heated by the heat pump 22 may have a temperature more or less lower than the air heated by a related art electric heater, the heat pump 22 can remove the moisture from the air without using a dehumidifier, additionally. Therefore, the air supplied to the housing space 12 by the heat pump 22 is 'low temperature air' relatively (In this case, the 'low temperature' means, not an absolutely low temperature, but a relatively low temperature compared to a related art heated air, though the air is heated air). The cloth treating apparatus in accordance with a preferred embodiment of the present invention can prevent the cloth from distorting or damaging by a high temperature if cloth refreshing or drying is performed by supplying the low temperature air. In conclusion, though the air supplied by the heat pump 22 has a temperature lower than the heated air of the related art cloth treating apparatus, since the cloth treating apparatus in accordance with a preferred embodiment of the present invention supplies the air having the moisture removed therefrom without the dehumidifier, easy drying or refreshing of the cloth is possible.

In detail, the machinery room 20 has an air inlet 21A (See FIG. 5) formed in an upper side of a front thereof for introducing the air from the housing space 12 thereto, and an introduction duct 29, connecting the air inlet 21A to the evaporator 24, the condenser 28, and the fan 22, forms a flow passage for flowing the air. The air introduced to the machinery room 20 through the introduction duct 29 and the air inlet 21A has the moisture removed therefrom and heated as the air passes through the heat pump 22, and is supplied to the housing space 12 through a discharge duct 33 and an air outlet 21B by the fan 32, again. In the meantime, the evaporator 24 and the condenser 28 which serve as heat exchangers in the heat pump 22 may be provided to an inside of the housing 23, and the housing 23 may be connected to the introduction duct 29 and the discharge duct 33 to form one air flow duct. Therefore, the air introduced through the air inlet 21A may circulate through the introduction duct 29, the discharged duct 33, and may be supplied to the housing space 12.

Though not shown, preferably, the air inlet 21A may have a filter provided thereto. By providing the filter to the air inlet 21A, various foreign matters may be filtered from the air introduced to the machinery room 20 from the housing space 12, to enable to supply only fresh air to the housing space 12.

In the meantime, in the cloth treating apparatus 100, the water supply unit 30 supplies the steam to the housing space 12, and the water supply unit 30 has the water supply line 36 or the water supply nozzle 40. In this case, the water supply line 36 and/or the water supply nozzle 40 is mounted to one side of the housing space 12 for supplying the steam to the housing space 12. That is, the water supply line 36 has one end connected to the steam generating unit 32, and the other end connected to the housing space 12, and, if the water supply line 36 is provided with the water supply nozzle 40, the water supply nozzle 40 is provided to an end of the water supply line 36 and mounted to one side of the housing space 12. In the meantime, if the water supply nozzle 40 is mounted to one side of the housing space 12, the steam can be supplied only at the mounted position, and is difficult to move the water supply nozzle 40 in a state the steam is being supplied. Such positional restriction of the steam supply acts as a factor that limits utilization of the cloth treating apparatus 100.

That is, there may be necessity for supplying the steam, not only in a case the cloth is housed in the housing space 12, but also in a case the cloth is positioned on an outside of the housing space 12, i.e., the cloth is spaced a predetermined distance from the housing space 12 or the cabinet 10. Moreover, there may be a case in which, since the user has no adequate time period for driving a predetermined course of the cloth treating apparatus, the user may be necessary to remove wrinkles, smells and so on from the cloth by supplying the steam for a moment before putting on the cloth. Especially, if contaminant is stuck to the cloth locally, i.e., a portion of the cloth, such as an elbow or the like, supplying the steam only to the contaminated portion intensively is effective for removing the contaminant, rather than supplying the steam throughout the cloth.

In above case, not a configuration fixed to one side of the housing space 12 for supplying the steam, but a configuration movable freely in a state the steam is being supplied is required. This will be discussed with reference to the drawings, in detail.

Figure 6:
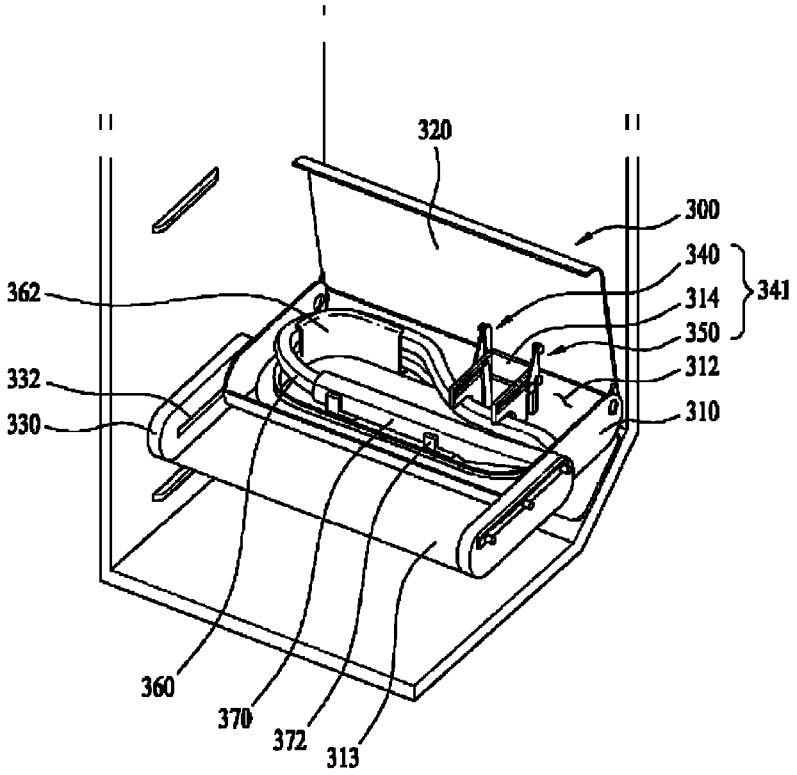
FIG. 6 illustrates a perspective view of a water spray unit in the cloth treating apparatus.

FIG. 6 illustrates a perspective view of a water spray unit 300 in a cloth treating apparatus. The inventor makes it clear that FIG. 6 illustrates only the water spray unit provided in the housing space 12.

Referring to FIG. 6, the water spray unit 300 is provided to one side of the cabinet 10 to be movable a predetermined distance, to enable to connect the same to the water supply unit 30, selectively. That is, if the steam supply is adequate only with the water supply unit 30, the water spray unit 300 is not connected to the water supply unit 30, and, for an example, if it is necessary to supply the steam to a portion of the cloth intensively, the water spray unit 300 is coupled to the water supply unit 30.

In detail, the water spray unit 300 is provided to one side of the housing space 12 to be movable a predetermined distance, to enable to connect the same to the water supply unit 30, selectively. For this, the water spray unit 300 may be provided with a housing 310 provided to one side of the housing space 12 to be movable a predetermined distance. The housing 310 has an opened upper side to provide a housing space 312 therein. The opened upper side may be opened/closed by a cover 320. And, the housing space 312 may house a water supply gun 370 and/or a water supply hose to be described later, therein.

The housing 310 may be provided to be movable within the housing space 12 between a first position at which the housing 310 does not couple to the water supply unit 30, and a second position at which the housing 310 couples to the water supply unit 30 to have the steam supplied thereto. As shown in FIG. 6, the housing 310 may be provided to be movable adjacent to a base of the housing space 12. This is for securing a space for placing the cloth in the housing space 12, and moreover, for making easy connection to the water supply nozzle 40 provided to the base of the housing space 12.

In the meantime, the housing space 12 may have a guide portion for guiding movement of the housing 310 for movement of the housing 310. As shown in FIG. 6, the guide portion may have one pair of guide rails 330 provided to opposite inside walls which form the housing space 12. The guide rails 330 may be fixedly secured to the inside walls adjacent to the base of the housing space 12 respectively, and may have grooves for guiding movement of the housing 310. And, the housing 310 may have projections (Not shown) placed in the grooves 332 in the guide rails, respectively. Therefore, the housing 310 is provided to be movable within a locus the projections are movable along the grooves 330 in the guide rails 330. Moreover, the guide portion may further provided with a base portion 313 for supporting the housing 310. The base portion 313 is provided to an underside of the housing 310 to guide the movement of the housing 310 while supporting the housing 310. For this, as shown, the base portion 313 may have both ends connected to the inside walls of the cabinet 10, preferably to the guide rails 330 described before.

A state the housing 310 does not move along the guide rails 330 is a state the housing 310 is positioned at the first position where the housing 310 does not couple to the water supply unit 30 (See FIG. 11), and, as shown in FIG. 6, if the housing 310 moves to a rear side along the guide rails 330, the housing 310 is positioned at the second position to position the housing 310 over the water supply nozzle 40 of the water supply unit 30, enabling the housing 310 to be connected to the water supply unit 30.

In the meantime, the water spray unit 300 may have a coupling unit 380 (See FIG. 7) provided in the housing 310 for selective connection to the water supply unit 30. The coupling unit 380 is provided on a lower side of the housing 310, so as to be connected to the water supply nozzle 40 for having the steam supplied thereto if the end of the water supply line 36 in the water supply unit 30 or the water supply nozzle 40 is ready to be connected thereto.

That is, the steam supplied to the coupling unit 380 through the water supply nozzle 40 as the coupling unit 380 is connected to the end of the water supply nozzle 40 is supplied to the water supply gun 370 to be described later through the coupling unit 380. The coupling unit 380 may be provided in a form of enclosing the water supply nozzle 40 such that the coupling unit 380 is able to receive the steam being supplied from the water supply nozzle 40. For an example, the coupling unit 380 may be provided to enclose a front of the water supply nozzle 40, through which the steam is supplied.

In the meantime, the coupling unit 380 may be connected to the water supply unit 30 as the housing 310 moves and/or acts. That is, in order to couple the coupling unit 380 to the water supply unit 30, the user moves, not the coupling unit 380 itself, but other element, for an example, the housing 310 which acts or moves to make the coupling unit 380 to couple to the water supply unit 30. Thus, if the coupling unit 380 couples to the water supply unit 30 interlocked to the action of the housing 310, the user can connect the coupling unit 380 to the water supply unit 30 conveniently by manipulating the housing 310 without necessity for moving the elements including the coupling unit, one by one.

In the embodiment, the coupling unit 380 can be coupled to the water supply unit 30 by two stages of movement and action of the housing 310. That is, if the housing 310 moves to the second position, the coupling unit 380 is positioned over the water supply nozzle 40 such that the coupling unit 380 can be connected to the water supply nozzle 40 (First movement and action). Then, if the user opens the cover 320 of the housing 310 (Second movement and action), the coupling unit 380 is connected to the water supply unit 30 interlocked with opening of the cover 320. Therefore, the water spray unit 300 may have a connection unit 341 which couples the coupling unit 380 to the water supply unit 30, specifically, to the water supply nozzle 40 interlocked with opening of the cover 320.

Referring to FIG. 6, the connection unit 341 may include a plurality of links. That is, the connection unit 341 connects the cover 320 to the coupling unit 380, to couple the coupling unit 380 to the water supply nozzle 40 by an opening action of the cover 320, and to decouple the coupling unit 380 from the water supply nozzle 40 by a closing action of the cover 320. The connection unit 341 has a first link unit 340 and a second link unit 350 symmetric to each other. A structure of the link unit will be described in detail, with reference to the drawings.

Figure 7:
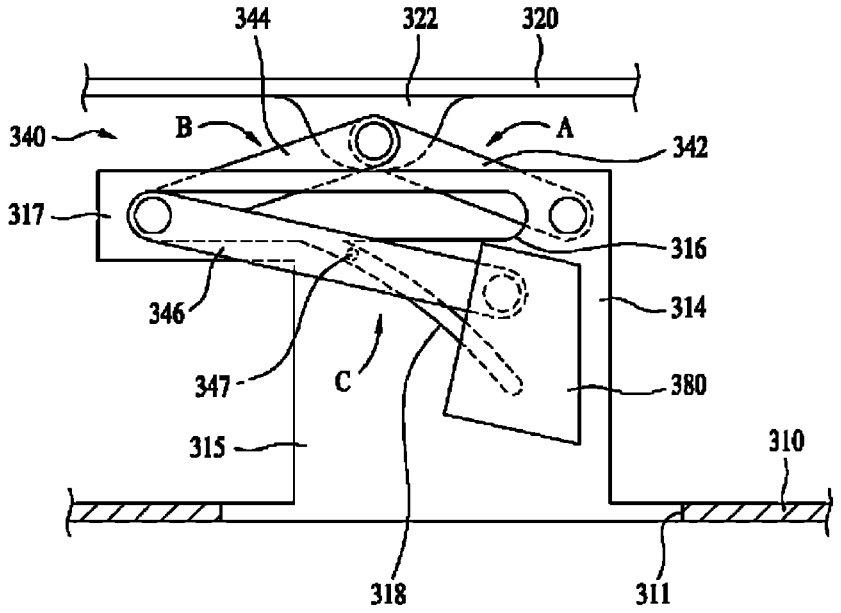
FIGS. 7 and 8 illustrate side views of the connection unit in FIG. 6, respectively.
Figure 8:
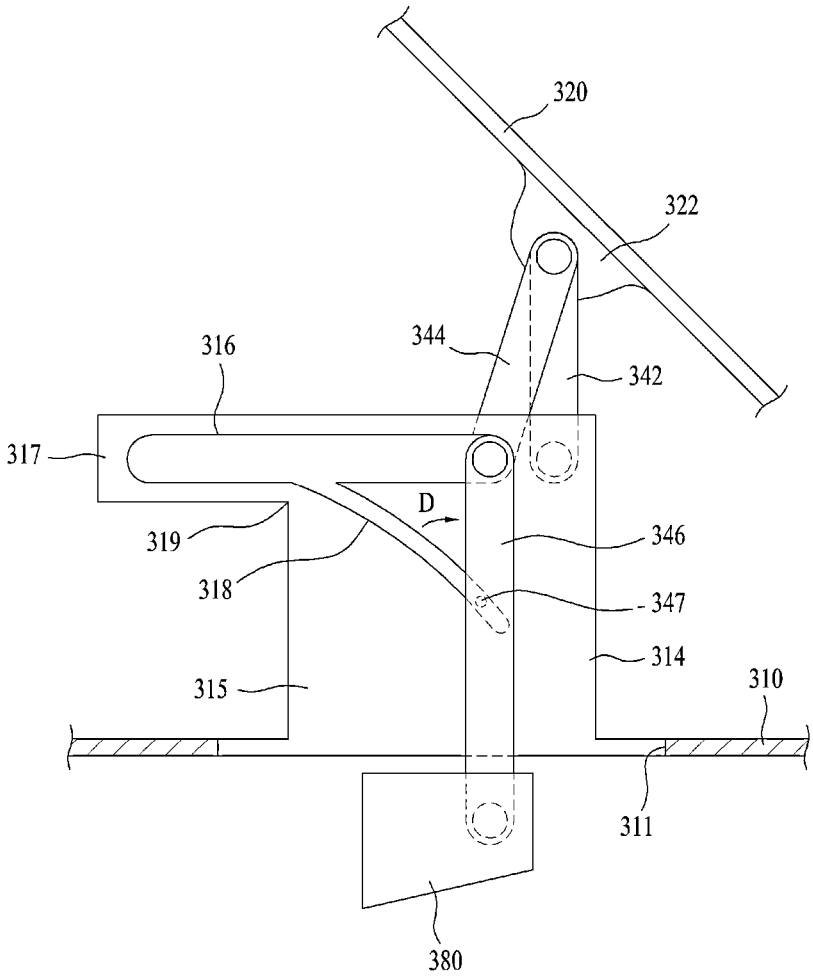

FIG. 7 illustrates the first link unit 340 and the frame 314 when the cover 320 is closed, and FIG. 8 illustrates the first link unit 340 and the frame 314 when the cover 320 is opened. The first link unit 340 will be described in detail, while omitting description of the second link unit 350 which is similar to the first link unit in configuration.

In detail, the housing 310 may have a frame 314 connected to the first link unit 340 and the second link unit 350 described before. The frame 314 is provided to an inside of the housing 310. The frame 314 may be formed as one unit with the housing 310. The embodiment suggests providing the frame 314 on a bottom of the housing 310. The frame may include a post 315 projected upward from the bottom of the housing 310, and an extension 317 provided to one end of the post 315. The extension 317 may be perpendicular to the post 317, and may have a first opening 316 to be described later formed therein. A connection part between the post 315 and the extension 317 has a recess 319 receiving the water supply hose 360. Namely, the water supply hose 360 is received between a bottom surface of the extension 317 and one side of the post 315.

The first link unit 340 includes a first link 342 rotatably connected to the cover 320 and the frame 314, respectively. The first link 342 has one end rotatably connected to the cover 320, and the other end rotatably connected to one side of the frame 314. The first link unit 340 may further include a second link 344 connected to the cover 320 and the frame 314. The second link 344 has one end rotatably connected to a rotation connection 322 at the cover 320, and the other end provided movable along the first opening 316 in the frame 314. The first opening 316 may be a rectangular slot. As the cover 320 is opening and closing, the other end of the second link 344 moves along the second opening 318 in the frame 314. The first link unit 340 may also include a third link 346 connected to the frame 314 and the coupling unit 380, respectively. In this case, the third link 346 has one end provided to be movable along the first opening in the frame 314, and the other end connected to the coupling unit 380. Moreover, the third link 346 and the second link 344 are connected to each other through the first opening 316 in the frame 314. At the end, the opening and closing of the cover 320 makes the other end of the second link unit 344 and one end of the third link 346 to move along the first opening 316. An action of the first link unit 340 which is interlocked with an action of the cover 320 will be described.

Referring to FIG. 7, if the cover 320 is in a closed state, the first link 342 and the second link 344 are positioned opposite to each other with respect to the rotation connection 322. That is, since the other end of the first link 342 is connected in a rotatable but immovable state, the first link 342 rotates toward the first opening 316 along an arrow mark A as the cover 320 is closed. And, since the second link 344 rotates in an arrow direction B as the cover 320 is closed, the other end of the second link 344 moves along the first opening 316 in the frame 314. At the end, the first link 342 and the second link 344 are put in a state in which the first link 342 and the second link 344 are unfolded in opposite directions.

In the meantime, since one end of the third link 346 is connected to the other end of the second link 344, the one end of the third link 346 also moves along the first opening 316. In this case, since the one end of the third link 346 and the other end of the second link 344 are rotatably connected to each other, if there is no other element, the other end (The end the coupling unit 380 is coupled thereto) of the third link 346 maintains a hang down state perpendicular to the first opening 316. If the third link 346 maintains such a state, the coupling unit 380 connected to the other end of the third link 346 is not housed in the housing 310, but positioned on an outside of the housing 310, not only resulting in a poor appearance, but also occupying a large space. Therefore, the frame 314 may further include the second opening 318 for guiding movement of the third link 346, and the third link 346 may have a projection 347 matched to the second opening 318. Though the drawing shows that the second opening 318 is configured to be in communication with the first opening 316, the configuration is not limited to this, but, for an example, it is also possible that the first opening 316 and the second opening 318 may not be in communication with each other in the frame 314, but the first opening 316 and the second opening 318 are provided, individually. As shown in FIG. 7, if the cover 320 is closed, since the projection 347 moves along the second opening 318, the third link 346 moves along an arrow mark C, making the coupling unit 380 to be housed in the housing 310.

In the meantime, FIG. 8 illustrates a cover 320 opened state.

Referring to FIG. 8, since the first link 342 has both ends connected to the cover 320 and the frame 314, if the cover 320 is opened, one end of the first link 342 rotates upward from the frame 314. In the meantime, since the second link 344 also has one end connected to the cover 320, the one end of the second link 344 moves upward and the other end of the second link 344 moves along the first opening 316. At the end, the second link 344 moves to an upper side of the frame 314 perpendicular to the first link 316, substantially.

And, the one end of the third link 346 moves along the first opening 316 interlocked with movement of the second link 344. And, if the third link 346 moves, since the projection 347 moves along the second opening 318, at the end, the third link 346 rotates in an arrow mark D direction toward a lower side of the frame 314 perpendicular to the first opening 316, substantially. In this case, the coupling unit 380 connected to the other end of the third link 346 heads downward to the lower side of the frame 314 to move beyond the bottom of the housing 310 through an opening 311 in the bottom of the housing 310, and is connected to the water supply nozzle 40.

In the meantime, referring to FIG. 6 again, the water spray unit 300 may further includes a water supply gun 370 to be connected to the coupling unit 380 for supplying the steam from the coupling unit 380 toward the cloth. In detail, the water supply gun 370 may be connected to the coupling unit with the water supply hose 360. The water supply hose 360 may be fabricated at a predetermined length appropriately. And, in order to enable the user to handle water supply gun 370 easily if the user holds the water supply gun 370 and supplies the steam, the water supply hose may be formed of a flexible material.

The water supply gun 370 and the water supply hose 360 described before may be housed in the housing space 312 of the housing 310. If the water supply gun 370 and the water supply hose 360 are provided to one side of the cabinet 10, not only storage thereof is not easy, but also appearance thereof is not good. Therefore, it is preferable that the housing space 312 is provided in the housing 310, for housing the water supply gun 370 and the water supply hose 360 therein. In the meantime, if the water supply gun 370 and the water supply hose 360 are housed in the housing 310, a hose fastening portion 362 for fastening the water supply hose 360 thereto, and a supply gun fastening portion 372 for fastening the water supply gun 370 thereto may be provided. That is, if the water spray unit 300 is not used, the user may dispose the water supply hose 360 along the hose fastening portion 362, and moreover, fastens the water supply gun 370 to the supply gun fastening portion 372, to re-arrange an inside of the housing 310. In the meantime, in order prevent the water supply hose 360 from interfering with the frame 314 if the water supply hose 360 is disposed in the housing 310, the frame 314 may have a recess 319 (referring FIG. 8). The water supply gun 370 for supplying the steam will be described, hereafter.

Figure 9:
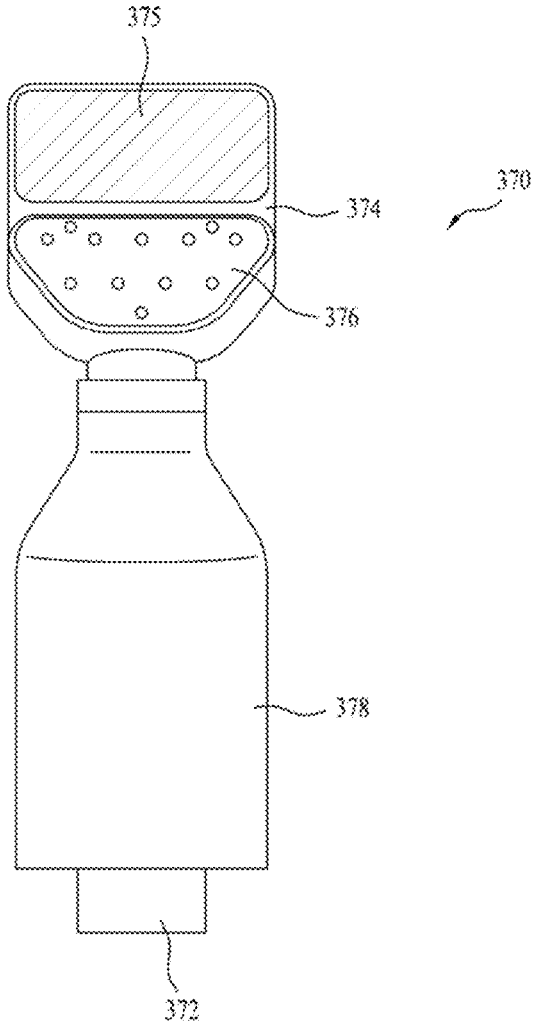
FIGS. 9 and 10 illustrate a front view and a side view of a water supply gun, respectively.
Figure 10:
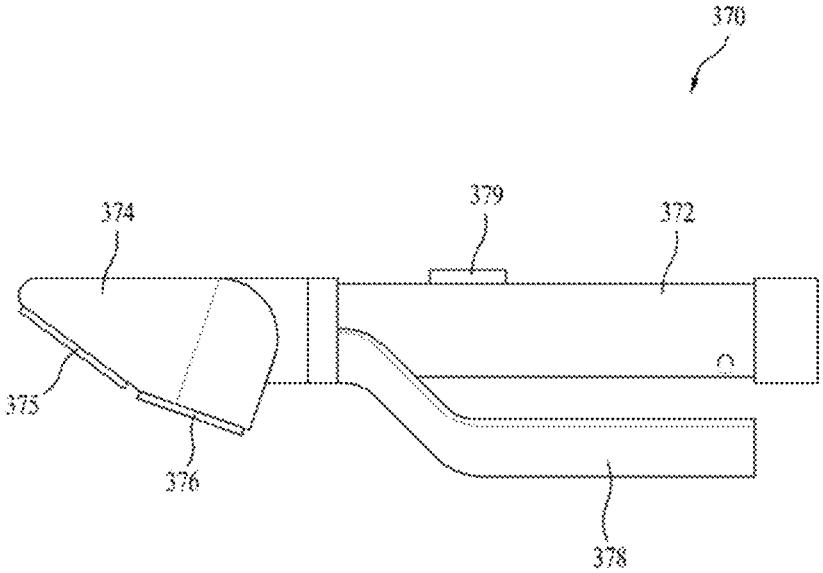

FIG. 9 illustrates a front view of the water supply gun 370, and FIG. 10 illustrates a side view of the water supply gun 370.

Referring to FIGS. 9 and 10, the water supply gun 370 may include a body 372 to be connected to the water supply hose 360, and a supply portion 374 provided to an end of the body 372 for supplying the steam. Though the supply unit 374 may be formed as one unit with the body 372, the supply unit 374 and the body 372 may be provided individually in view of easy fabrication as shown in the drawings. The supply portion 374 may have a supply area 376 at a front thereof with a plurality of steam supply holes for supplying the steam. And, the supply portion 374 may have a foreign matter removal portion 375 at the front thereof for removing foreign matter, such as lint, stuck to the cloth.

Referring to FIG. 10, the steam supply area 376 and the foreign matter removal portion 375 at the front of the supply portion 374 may be provided to have predetermined angles. If both the steam supply area 376 and the foreign matter removal portion 375 are formed at the supply portion 374 a front of which is formed flat, and if the foreign matter removal portion 375 is brought into close contact to the cloth to remove the foreign matter from the cloths, the steam supply area 376 will also be brought into close contact to the cloth in the same fashion. If the steam supply area 376 is in close contact to the cloth for supplying the steam to the cloth thus, making direct contact of the comparatively high temperature steam to the cloth, the steam may wet the cloth, on the contrary. Accordingly, the front of the supply portion 374 is divided into two regions to have predetermined angles for providing the steam supply area 376 and the foreign matter removal portion 375, individually. In a case of FIG. 10, even if the foreign matter removal portion 375 is brought into close contact to the cloth, the steam supply area 376 is not in close contact to the cloth, but is able to maintain a predetermined gap.

In the meantime, in order to prevent a user's hand or the like from exposing to the steam directly if the user uses the water supply gun 370, the water supply gun 370 may further include a protector 378. As shown in FIG. 10, the protector 378 may be provided extended from a lower side of the supply portion 374 to surround at least a portion of the body 372, and in order to secure a space the user's hand is to be placed therein, the protector 378 may be provided to form a predetermined space from the body 372.

In the meantime, the foregoing description describes a case the steam from the steam generating unit 32 in the water supply unit 30 is supplied through the water spray unit 300. However, a case the steam is generated by operating the heater in the steam generating unit 32 may be set in a variety of modes.

For an example, a control panel (Not shown) may be provided to a predetermined portion, for an example, to a front of the door 14, of the cloth treating apparatus, and the control panel may be provided with at least one course. By manipulating the control panel, the user may select a steam supply course and drives the cloth treating apparatus, to supply the steam through the water spray unit 300.

In another case, a predetermined manipulator 379 may be provided to the water supply gun 370 described before. In this case, the manipulator 379 may be provided with, for an example, a steam supply button and a steam supply cutoff button which are able to communicate with the control unit in the cloth treating apparatus with wire or wirelessly. Accordingly, if the user draws out the water supply gun 370 and manipulates the manipulator 379 of the water supply gun 370, the manipulator 379 transmits an order to the control unit to drive the steam generating unit 32 to supply the steam to the water spray unit 300. This case is advantageous in that the steam can be supplied at once by manipulating the water supply gun 370 without manipulation of the control panel on the cloth treating apparatus 100.

The operation of the water spray unit 300 having above configuration will be described with reference to the drawings.

Figure 11:
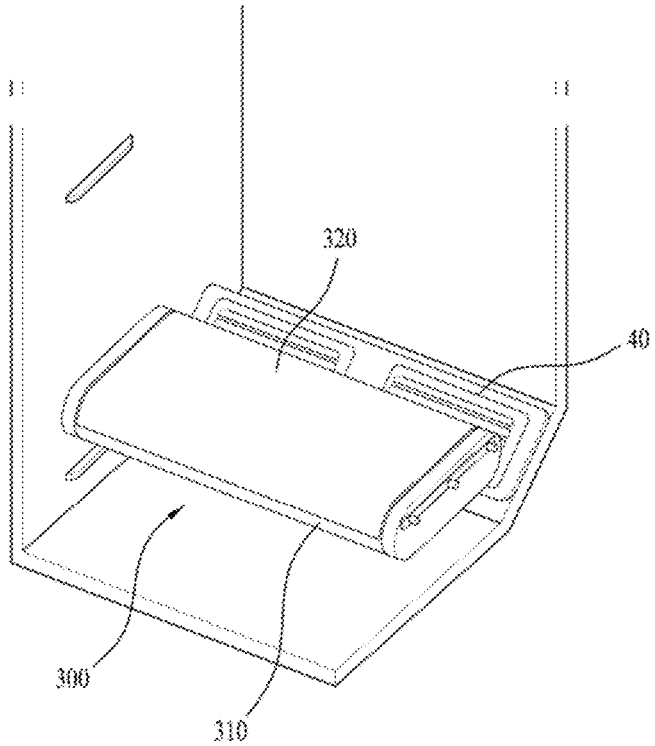
FIGS. 11 to 16 illustrate movements of a water spray unit, respectively.
Figure 12:
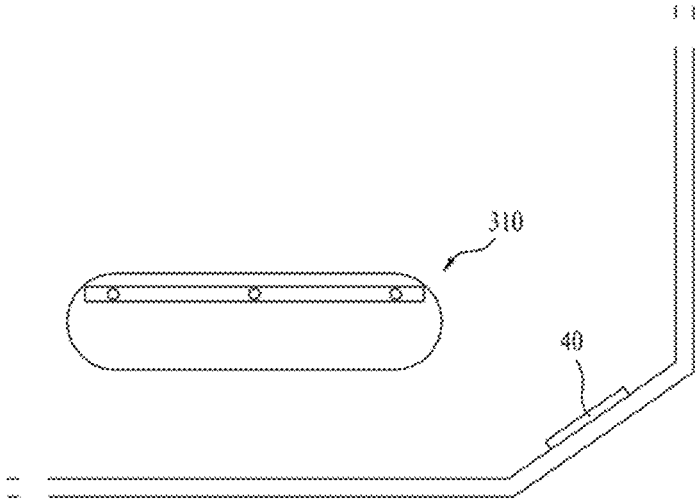
Figure 13:
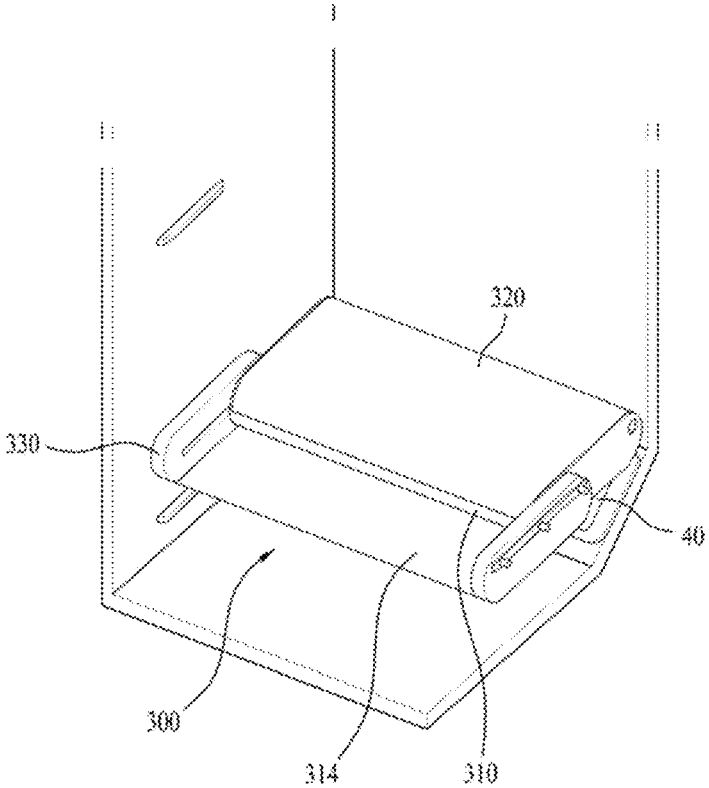
Figure 14:
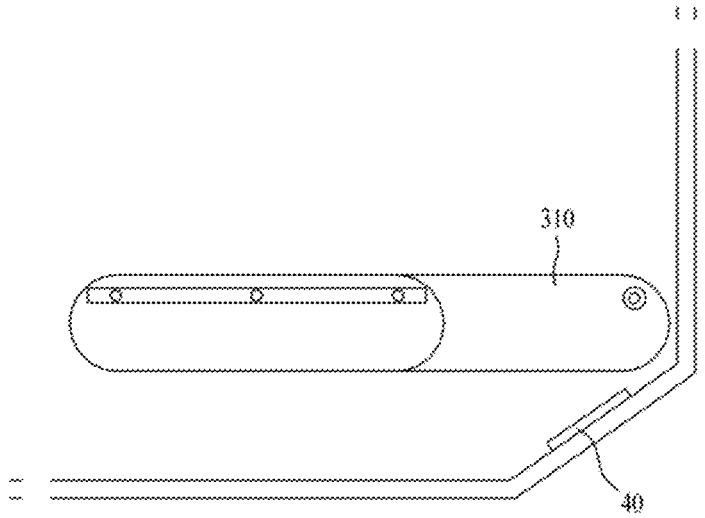
Figure 15:
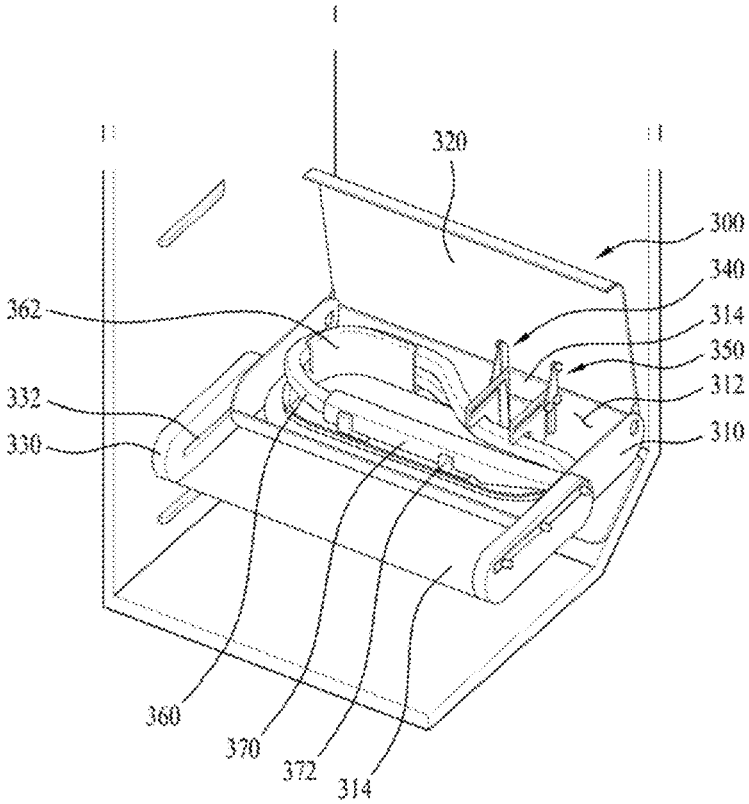
Figure 16:
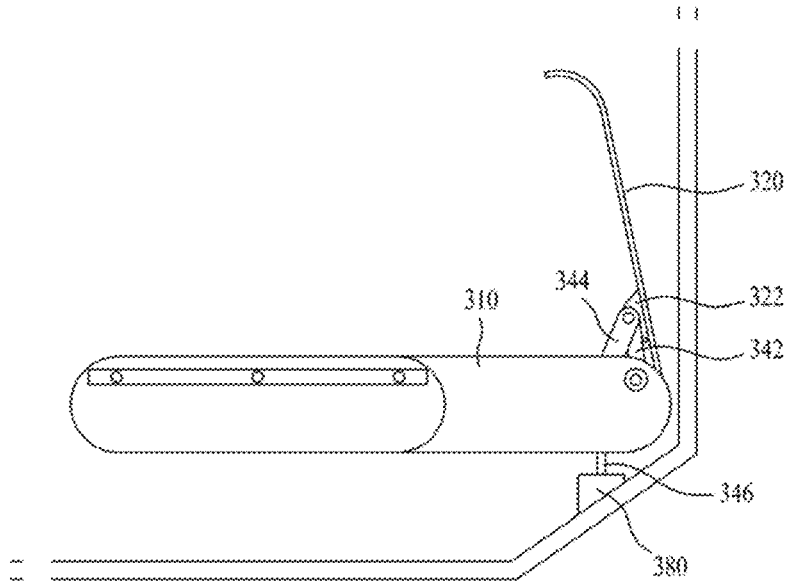
Figure 17:
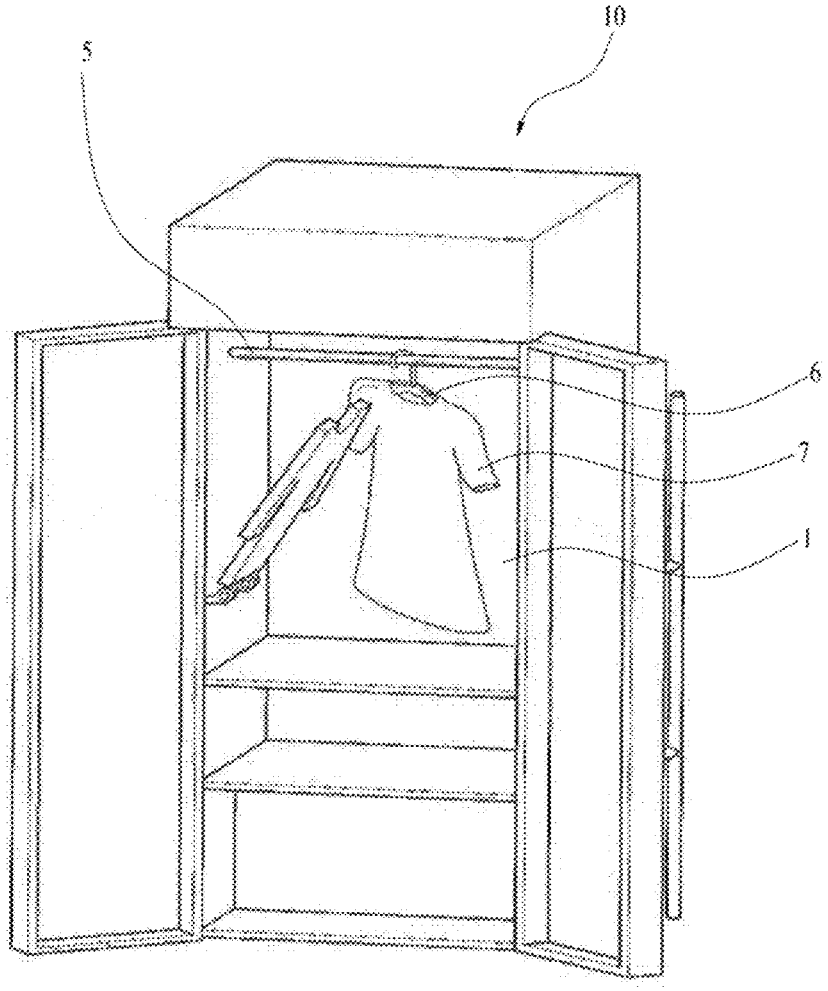
FIG. 17 illustrates a perspective view of a related art cloth treating apparatus.

FIGS. 11 to 16 illustrate movements of the water spray unit 300, respectively. FIG. 11 illustrates a perspective view of a state the housing 310 of the water spray unit 300 is placed at the first position, showing the cloth treating apparatus partially, and FIG. 12 illustrates a side view of FIG. 11. FIG. 13 illustrates a perspective view of a state the housing 310 of the water spray unit 300 is placed at the second position, showing the cloth treating apparatus partially, and FIG. 14 illustrates a side view of FIG. 13. FIG. 15 illustrates a perspective view of a state the coupling unit 380 is connected to the water supply nozzle 40 as the cover 320 is opened, and FIG. 16 illustrates a side view of FIG. 15.

Referring to FIGS. 11 and 12, if steam supply from the water supply unit 30 is adequate, the user does not move the water spray unit 300 from the first position. Therefore, the water spray unit 300 stays at the first position, and the housing 310 maintains a predetermined space above the water supply nozzle 40.

Then, if the user intends to supply the steam with the water spray unit 300, as shown in FIG. 13, the user pushes the housing 310 along the guide rails 330 to place the housing 310 at the second position. In this case, the housing 310 is pushed backward as shown in FIG. 14 to position the opening 311 in a lower side of the housing 310 over the water supply nozzle 40.

Then, referring to FIGS. 15 and 16, the user opens the cover 320 on the housing 310, moving the coupling unit 380 to the lower side of the housing 310 owing to the connection unit 341 interlocked with the opening action of the cover 320 such that the coupling unit 380 is connected to the water supply nozzle 40. The user may take out the water supply gun 370 and the water supply hose 360 from an inside of the housing 310, and may supply the steam to a portion the user intends to supply, intensively.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A cloth treating apparatus comprising:

a cabinet having a housing space for housing cloth;

a water supply unit for supplying steam to the housing space, selectively; and a water spray unit movably provided to one side of the cabinet to be connected to the water supply unit selectively for supplying the steam from the water supply unit to the cloth, wherein the water spray unit comprises:

a housing movably provided to one side of the housing space to have an opened upper side, a coupling unit provided to the housing for selective connection to the water supply unit according to movement and action of the housing, and a water supply gun connected to the coupling unit and extended to a predetermined distance for supplying the steam toward the cloth.

2. The cloth treating apparatus as claimed in claim 1, wherein the water supply unit includes;

a steam generating unit provided to one side of the cabinet for generating the steam, and a water supply line for guiding the steam from the steam generating unit to the housing space.

3. The cloth treating apparatus as claimed in claim 2, wherein the water supply unit further includes a water supply nozzle at an end of the water supply line for supplying the steam to the housing space.

4. The cloth treating apparatus as claimed in claim 3, wherein the water spray unit is connected to the end of the water supply line or the water supply nozzle, selectively.

5. The cloth treating apparatus as claimed in claim 1, wherein the water spray unit is movably provided to one side of the housing space and connected to the water supply unit, selectively.

6. The cloth treating apparatus as claimed in claim 1, wherein the housing is movable between a first position at which the housing does not couple to the water supply unit, and a second position at which the housing is able to couple to the water supply unit.

7. The cloth treating apparatus as claimed in claim 6, further comprising a guide portion provided to one side of the housing space for guiding movement of the housing.

8. The cloth treating apparatus as claimed in claim 1, wherein the water spray unit further includes a cover for selective opening/closing of the opened upper side of the housing, and the coupling unit is connected to the water supply unit interlocked with opening of the cover of the housing.

9. The cloth treating apparatus as claimed in claim 8, wherein the water spray unit further includes a connection unit for selective coupling of the coupling unit to the water supply unit interlocked with opening of the cover.

10. The cloth treating apparatus as claimed in claim 9, wherein the connection unit includes a plurality of links rotatably connected to each other.

11. The cloth treating apparatus as claimed in claim 1, wherein the water supply gun is connected to the coupling unit with a water supply hose of a predetermined length, and the housing has a housing space for housing the water supply nozzle and the water supply hose therein.

12. The cloth treating apparatus as claimed in claim 11, wherein the water supply gun includes;

a body connected to the water supply hose, a supply portion at an end of the body for supplying the steam; and a protector extended from the supply portion to surround at least a portion of the body with a predetermined gap from the body.

13. The cloth treating apparatus as claimed in claim 1, further comprising an air supply unit for supplying air or heated air to the housing space.

14. The cloth treating apparatus as claimed in claim 13, wherein the air supply unit includes a heat pump having an evaporator, a compressor, and a condenser for circulating refrigerant.

15. The cloth treating apparatus as claimed in claim 1, further comprising a movable hanger for hanging the cloth therefrom and applying a predetermined movement to the cloth.

* * * * *